US012188669B2

(12) United States Patent
Ding et al.

(10) Patent No.: US 12,188,669 B2
(45) Date of Patent: Jan. 7, 2025

(54) BI-LEVEL OPTIMIZATION SCHEDULING METHOD FOR AIR CONDITIONING SYSTEM BASED ON DEMAND RESPONSE

(71) Applicant: Tianjin University, Tianjin (CN)

(72) Inventors: Yan Ding, Tianjin (CN); Luheng Liu, Tianjin (CN); Chen Huang, Tianjin (CN); Qiaochu Wang, Tianjin (CN)

(73) Assignee: Tianjin University, Tianjin (CN)

( * ) Notice: Subject to any disclaimer, the term of this patent is extended or adjusted under 35 U.S.C. 154(b) by 87 days.

(21) Appl. No.: 18/126,452

(22) Filed: Mar. 26, 2023

(65) Prior Publication Data

US 2023/0417438 A1 Dec. 28, 2023

(30) Foreign Application Priority Data

Jun. 28, 2022 (CN) ..... 202210743796.4

(51) Int. Cl.
*F24F 11/47* (2018.01)
*F24F 11/64* (2018.01)
(Continued)

(52) U.S. Cl.
CPC ..... *F24F 11/47* (2018.01); *F24F 11/64* (2018.01); *F24F 2110/10* (2018.01); *F24F 2140/50* (2018.01); *F24F 2140/60* (2018.01)

(58) Field of Classification Search
None
See application file for complete search history.

(56) References Cited

U.S. PATENT DOCUMENTS

2007/0018133 A1* 1/2007 Kanamori ..... G06F 30/20 252/62
2012/0065783 A1* 3/2012 Fadell ..... F24F 11/30 703/7

(Continued)

OTHER PUBLICATIONS

CNIPA, Notification of a First Office Action for CN202210743796.4, Feb. 26, 2024.

(Continued)

*Primary Examiner* — Kenneth M Lo
*Assistant Examiner* — Istiaque Ahmed
(74) *Attorney, Agent, or Firm* — Hemisphere Law, PLLC; Zhigang Ma

(57) ABSTRACT

A bi-level optimization scheduling method for an air conditioning system based on demand response includes: constructing a lumped heat capacity model to describe a heat storage capacity of a building to thereby obtain a building heat storage model; obtaining a function relational expression of describing an indoor dry bulb temperature and a cooling and heating load of the building based on the building heat storage model; constructing a power consumption calculation model under a working condition of demand response based on the function relational expression; constructing optimization objective functions based on the power consumption calculation model; and substituting the optimization objective functions into a bi-level optimization process, and optimizing the bi-level optimization process to obtain an optimal scheduling strategy for the air conditioning system participating in demand response. The method can achieve a global optimization of demand response scheduling strategy, and improve economy and energy saving of system operation.

3 Claims, 4 Drawing Sheets

(51) Int. Cl.

| | |
|---|---|
| ***F24F 110/10*** | (2018.01) |
| ***F24F 140/50*** | (2018.01) |
| ***F24F 140/60*** | (2018.01) |

(56) References Cited

U.S. PATENT DOCUMENTS

| | | | | |
|---|---|---|---|---|
| 2018/0113482 | A1* | 4/2018 | Vitullo | G06N 20/20 |
| 2022/0381470 | A1* | 12/2022 | Song | G05B 19/042 |

OTHER PUBLICATIONS

Tianjin University (Applicant), Reply to Notification of a First Office Action for CN202210743796.4, w/ (allowed) replacement claims, Mar. 1, 2024.

CNIPA, Notification to grant patent right for invention in CN202210743796.4, Mar. 13, 2024.

* cited by examiner

BI-LEVEL OPTIMIZATION SCHEDULING METHOD FOR AIR CONDITIONING SYSTEM BASED ON DEMAND RESPONSE

TECHNICAL FIELD

The disclosure relates to the field of computing, and particularly to a bi-level optimization scheduling method for an air conditioning system based on demand response.

BACKGROUND

With increasing problems of energy shortage and environmental pollution, efficient and sustainable green energy usage has become a main theme of the current social development. Until the year 2025, there is a prediction that "proportion of non-fossil energy consumption will reach about 20%, a total installed capacity of wind power generation and solar power generation will reach more than 1.2 billion kilowatts". However, since sustainable energy sources such as the wind generated power and the solar energy generated power have obvious intermittency and fluctuation in time, so that when the above described energy sources are connected to a power grid, there will be significant differences between a supply end and a demand end of the power grid; and with an increasing popularity of electric vehicles, charging demands of the electric vehicles are uncertain, exacerbating an imbalance between the supply end and the demand end of the power grid, thereby affecting reliability and stability of the power grid to supply power.

In recent years, demand response management (DRM) has been considered as an effective method to improve a running state of the power grid and to address the imbalance of the power grid. As an important department on the demand end of the power grid, a building energy system can change its power load curve in response to demands of the power grid, thus balancing the differences between the supply end and the demand end of the power grid, and eliminating instability of production capacity of distributed renewable energy sources. However, there are several critical issues on utilizing demand flexibilities of a building, the most important among which is to achieve an optimal scheduling on flexible resources. Furthermore, an air conditioning system is of great importance in a building energy system, so that when the demand response management is performed on the building energy system, the most important thing is to make full use of the flexibility of the air conditioning system.

However, a flexibility of an active energy storage strategy of the air conditioning system mainly depends on its water tank energy storage capacity, and a setting of day-ahead water tank energy storage capacity has a significant impact on demand response effect of daily running of the air conditioning system. Therefore, when considering an optimal scheduling strategy of the air conditioning system based on the demand response, how to fully consider a reasonable combination of various demand response strategies in a demand response stage during setting the water tank energy storage capacity in an energy storage phase is an important issue. However, optimization variables of the optimization problem are interrelated and have time sequencing, a commonly used single-level optimization structure is often difficult to achieve a desired optimization effect.

SUMMARY

To solve the above-mentioned problem in the art, the disclosure provides a bi-level optimization scheduling method for an air conditioning system based on demand response. The method fully considers a reasonable combination of various demand response strategies in a demand response stage during setting a water tank energy storage capacity in an energy storage phase, so that a day-ahead water tank energy storage capacity matches a daily running strategy of the air conditioning system, realizing a global optimization of demand response scheduling strategy for the air conditioning system, making full use of a demand respond potential of the air conditioning system, and improving economy and energy saving of the system in operation.

In order to achieve the above objective, the disclosure provides a bi-level optimization scheduling method for an air conditioning system based on demand response, including the following steps:

- step 1, constructing a lumped heat capacity model to describe a heat storage capacity of a building, thereby obtaining a building heat storage model;
- step 2, based on the building heat storage model, obtaining a function relational expression of describing an indoor dry bulb temperature of the building and a cooling and heating load of the building;
- step 3, based on the function relational expression, constructing a power consumption calculation model under a working condition of demand response;
- step 4, based on the power consumption calculation model, constructing optimization objective functions; and
- step 5, substituting the optimization objective functions into a bi-level optimization process, and optimizing the bi-level optimization process to obtain an optimal scheduling strategy for the air conditioning system participating in demand response. Moreover, in some embodiments, the bi-level optimization scheduling method further includes: scheduling the air conditioning system for the building under a demand response condition based on the optimal scheduling strategy.

In an embodiment, the lumped heat capacity model in the step 1 describes the heat storage capacity of the building in four aspects; and the four aspects include: a heat storage capacity of walls of an envelope structure of the building, a heat storage capacity of indoor air of the building, a heat storage capacity of partition walls, furniture, and roof thermal mass of the building and a heat storage capacity of an air conditioning water system.

In an embodiment, the step 2 includes: identifying parameters in the building heat storage model based on a Grey Wolf algorithm to obtain the function relational expression between the indoor dry bulb temperature of the building and the cooling and heating load of the building.

In an embodiment, the step 3 includes: based on the function relational expression, constructing a cooling and heating source component model, an active energy storage component model, a passive energy storage component model, and an accessory component model; and performing parameter identification and model integration on the cooling and heating source component model, the active energy storage component model, the passive energy storage component model and the accessory component model in sequence to obtain the power consumption calculation model.

In an embodiment, the optimization objective functions in the step 4 include: flexibility objective functions, a cost objective function, and an energy consumption objective function.

In an embodiment, the bi-level optimization includes: an upper-level optimization, which is an optimization of day-ahead water tank energy storage capacity of the air conditioning system, and a lower-level optimization, which is an optimization of daily running parameters of the air conditioning system.

The disclosure may achieve technical effects as follows.

1. Embodiments of the disclosure, through a bi-level structure of the bi-level optimization scheduling method and the setting of objective functions and the transferring of parameters between the upper and lower levels of the optimization algorithm, realize an optimal matching between the day-ahead water tank energy storage capacity of the air conditioning system and the daily running of the air conditioning system, and therefore, the economy and energy saving of system operation is improved under the premise of meeting a load reduction demand.
2. Embodiments of the disclosure, during using the lumped heat capacity model (i.e. RC model) to construct the heat storage capacity of a building, cover as comprehensively as possible all of components with heat storage capacity in the building and add a 1R1C branch (also referred to a branch with one resistor and one capacitor) to describe the heat storage capacity of the air conditioning water system; and meanwhile, perform reduced-order processing on branches of the external envelope structure and the internal thermal mass, and use a 3R1C branch to describe a heat transfer process of the envelope structure and a 1R1C branch to describe a heat transfer process of the internal thermal mass; thereby reducing the structural complexity of model and improving the stability of computing.
3. Embodiments of the disclosure focus on temporal characteristics in the demand response phase of the air conditioning system, proposes to quantify flexibility of the air conditioning system with an energy flexibility index and a power flexibility index, and gives a modeling method of the power consumption of the air conditioning system under demand response and a calculation method of the quantified flexibility indexes, thereby laying the foundation for efficient allocation and utilization of flexible resources of the air conditioning system.

BRIEF DESCRIPTION OF DRAWINGS

In order to illustrate technical solutions in embodiments of the disclosure more clearly, the attached drawings used in the illustrated embodiments are briefly described below. Apparently, the attached drawings in the following description are some embodiments of the disclosure, and other drawings may be obtained from them without creative effort to those skilled in the art.

DETAILED DESCRIPTION OF EMBODIMENTS

The following will clearly and completely describe technical solutions in embodiments of the disclosure in combination with the attached drawings in the embodiments of the disclosure. Apparently, the described embodiments are only some of embodiments of the disclosure, not all of embodiments of the disclosure. Based on the described embodiments in the disclosure, all other embodiments obtained by those skilled in the art without creative effort fall within the scope of protection of the disclosure.

Embodiments of the disclosure will be exemplarily illustrated as follows.

Figure 1:
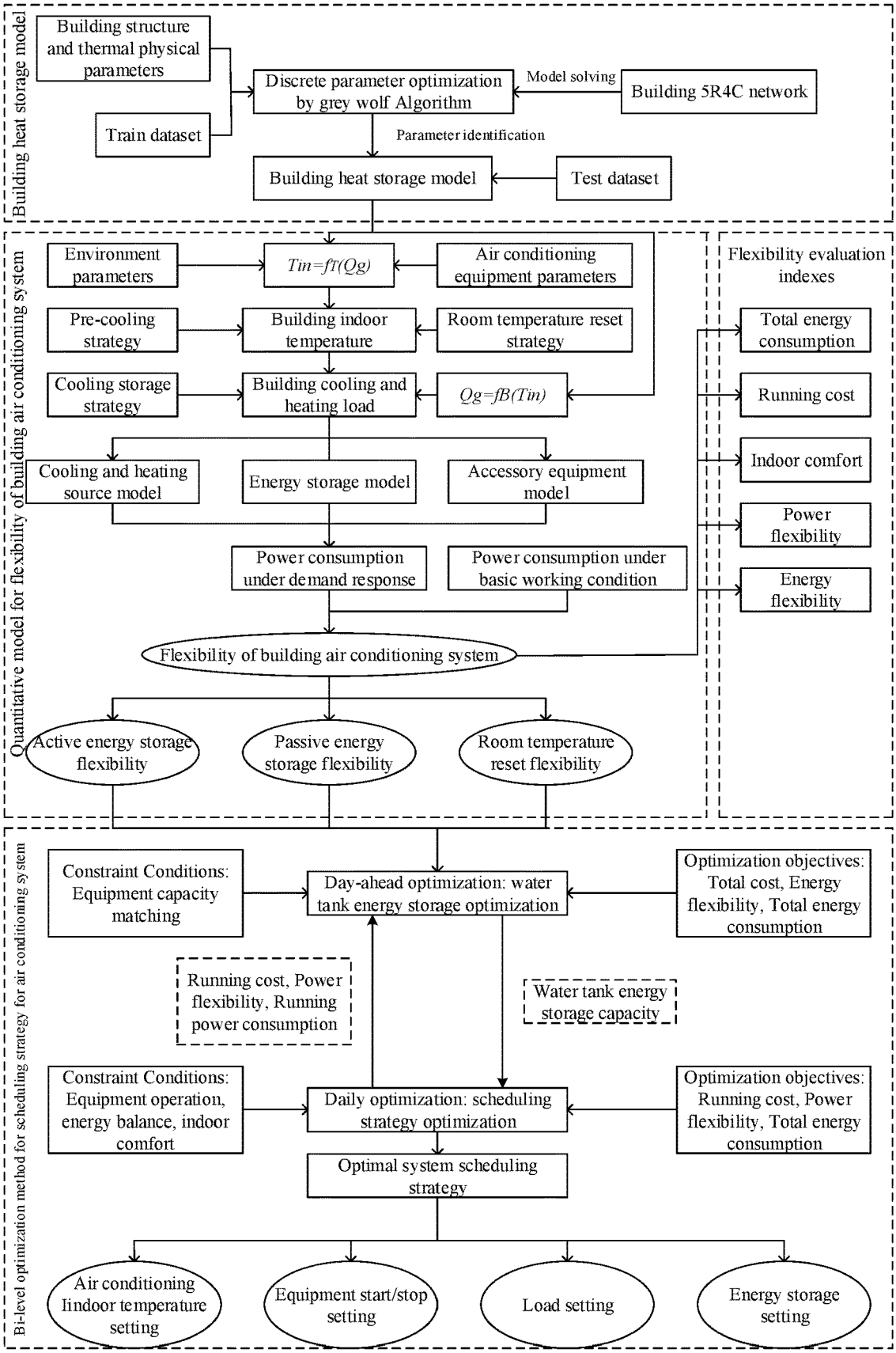
FIG. 1 illustrates a schematic flowchart of a bi-level optimization scheduling method for an air conditioning system based on demand response according to an embodiment of the disclosure.

As shown in FIG. 1, an embodiment of the disclosure provides a bi-level optimization scheduling method for an air conditioning system based on demand response, including the following steps.

Step 1, a lumped heat capacity model is constructed to describe a heat storage capacity of a building, thereby obtaining a building heat storage model.

Figure 2:
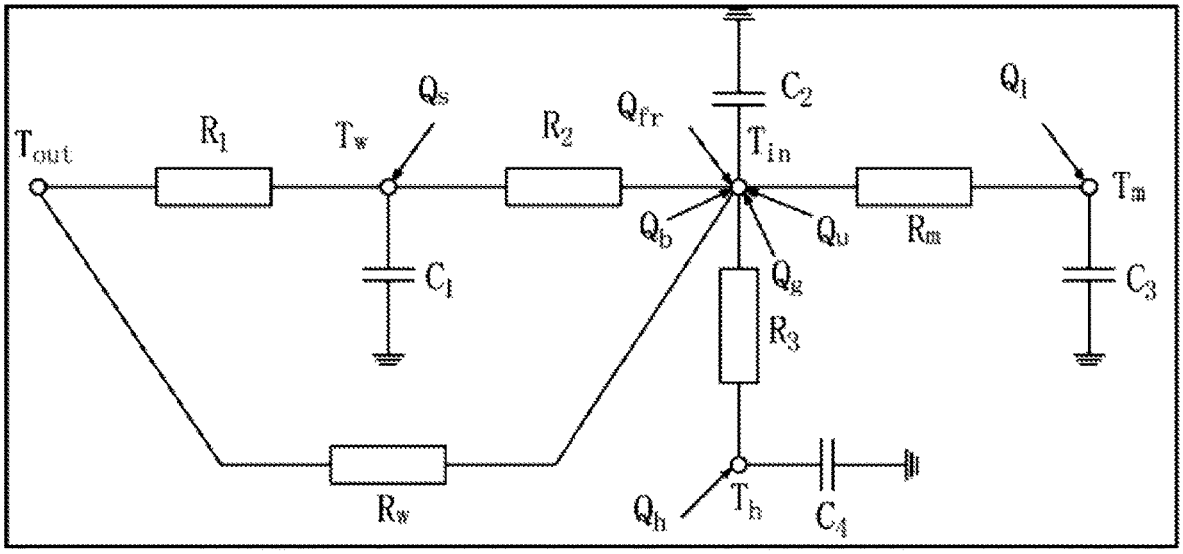
FIG. 2 illustrates a schematic structural diagram of a RC model according to an embodiment of the disclosure.

The lumped heat capacity model (i.e. Resistor-Capacitor (RC) model) is constructed according to heat transfer processes inside the building, including a 3R1C (referred to a branch with three resistors and one capacitors) heat storage model of an envelope structure of the building, a 1R1C (referred to a branch with one resistor and one capacitor) heat storage model of indoor thermal mass of the building, and a 1R1C (referred to a branch with one resistor and one capacitor) heat storage model of an air conditioning water system of the building; furthermore, a heat capacity of indoor air of the building is simplified as a capacitor (shown by $C_2$ in FIG. 2), thereafter obtaining the RC model. As shown in FIG. 2, the RC model in the embodiment of the disclosure is a 5R4C network model.

In the embodiment, the RC model describes the heat storage capacity of the building from four parts, including a heat storage capacity of walls of an envelope structure of the building, a heat storage capacity of the indoor air of the building, a heat storage capacity of partition walls, furniture, and roof thermal mass of the building and a heat storage capacity of the air conditioning water system of the building. Then, a virtual thermal network is respectively established to simulate each of the heat transfer processes of the above four parts, thereby obtaining the building heat storage model. The heat transfer processes of the above four parts of the building heat storage model can be expressed as follows.

The heat transfer process of the walls of the envelope structure of the building is expressed as follows:

$$Q_S + \frac{T_{out} - T_w}{R_1} + \frac{T_{in} - T_w}{R_2} = C_1 \frac{dT_W}{dt},$$

-continued $$Q_w = \frac{T_{out} - T_{in}}{R_w} + Q_l,$$

$$Q_{1,n} = \alpha \times A_{1,n} \times I_{s,n}, \text{ and}$$

$$Q_1 = Q_{1,n} + Q_{1,w} + Q_{1,s} + Q_{1,e}.$$

In the formula, $R_1$ and $R_2$ represent equivalent thermal resistors for heat transfer of opaque exterior envelope structure of the building (with a unit of Kelvin temperature per kilowatt (K/kW)); $T_W$ represents a temperature of a virtual node of the opaque exterior envelope structure of the building (with a unit of Celsius degree (° C.)); $Q_S$ represents solar radiation heat absorbed by surfaces of the envelope structure (with a unit of kilowatt (kW)); $C_1$ represents an equivalent thermal capacitor of the opaque exterior envelope structure of the building (with a unit of kilojoule per Kelvin temperature (kJ/K)); $Q_W$ represents heat entering indoor through transparent envelope structure (with a unit of kW); $Q_{1,n}$ represents solar radiation heat transmitted by north transparent envelope structure of the building (with a unit of kW); $Q_1$ represents solar radiation heat transmitted by the transparent envelope structure of the building (with a unit of kW); $R_W$ represents an equivalent thermal resistor for heat transfer of the transparent envelope structure of the building (with a unit of K/kW); $T_{out}$ represents a dry bulb temperature of an outdoor environment of the building (with a unit of ° C.); $T_{in}$ represents a volume average dry bulb temperature of indoor space of the building (with a unit of ° C.); α represents a transmittance of the transparent envelope structure of the building (%); $A_{1,n}$ represents an area of the north transparent envelope structure of the building (with a unit of square meter ($m^2$)); $I_{s,n}$ represents solar radiation intensity perpendicular to the north transparent envelope structure of the building (with a unit of kW); and $Q_{1,w}$, $Q_{1,s}$, $Q_{1,e}$ represent solar radiation heat transmitted by west transparent envelope structure, south transparent envelope structure and east transparent envelope structure of the building, the calculation methods for which are consistent with that of the north transparent envelope structure of the building (with a unit of kilowatt (kW)).

The heat transfer process of the inner thermal mass of the building is expressed as follows:

$$Q_l + \frac{T_{in} - T_m}{R_m} = C_3 \frac{dT_m}{dt}$$

In the formula, $Q_1$ represents the solar radiation heat transmitted by the transparent envelope structure of the building (with a unit of kW); $T_m$ represents a temperature of a node of the inner thermal mass of the building (with a unit of ° C.); $T_{in}$ represents the volume average dry bulb temperature of the indoor space of the building (with a unit of ° C.); $R_m$ represents an equivalent thermal resistor for heat transfer of the indoor thermal mass of the building (with a unit of K/kW); $C_3$ represents an equivalent thermal capacitor of the inner thermal mass of the building (with a unit of kJ/K).

The heat transfer process of the air conditioning water system of the building is expressed as follows:

$$Q_h + \frac{T_{in} - T_h}{R3} = C_4 \frac{dT_h}{dt}$$

In the formula, $Q_h$ represents a heat supply capacity of the air conditioning system in the building (with a unit of kW); $T_{in}$ represents the volume average dry bulb temperature of the indoor space of the building (with a unit of ° C.); $T_h$ represents a temperature of a virtual node of the air conditioning water system (with a unit of ° C.); $R_3$ represents an equivalent thermal resistor for heat transfer of a terminal equipment in the air conditioning system (with a unit of K/kW); $C_4$ represents an equivalent thermal capacitor of the air conditioning water system (with a unit of kJ/K).

The heat transfer process of the indoor air of the building is expressed as follows:

$$\frac{T_w - T_{in}}{R_2} + \frac{T_h - T_{in}}{R_3} + \frac{T_m - T_{in}}{R_m} + \frac{T_{out} - T_{in}}{R_w} + Q_g + Q_{fr} + Q_u + Q_b = C_2 \frac{dT_{in}}{dt}$$

$$T_{in} = \frac{\sum_{i=1}^{k} N_i \times T_i}{k}.$$

In the formula, $T_w$ represents the temperature of the virtual node of the opaque exterior envelope structure of the building (with a unit of ° C.); $T_{in}$ represents the volume average dry bulb temperature of the indoor space of the building (with a unit of ° C.); $R_2$ represents the equivalent thermal resistor for heat transfer of the opaque exterior envelope structure (with a unit of K/kW); $T_h$ represents the temperature of the virtual node of the air conditioning water system (with a unit of ° C.); $R_3$ represents the equivalent thermal resistor for heat transfer of the terminal equipment in the air conditioning system (with a unit of K/kW); $T_m$ represents the temperature of the node of the inner thermal mass of the building (with a unit of ° C.); $T_{out}$ represents the dry bulb temperature of the outdoor environment of the building (with a unit of ° C.); $R_w$ represents the equivalent thermal resistor for heat transfer of the transparent envelope structure of the building (with a unit of K/kW); $Q_g$ represents heat dissipation of personnel inside the building (with a unit of kW); $Q_{fr}$ represents heat dissipation of indoor fresh air of the building (with a unit of kW); $Q_u$ represents heat dissipation of indoor equipment of the building (with a unit of kW); $Q_b$ represents heat dissipation of indoor lighting of the building (with a unit of kW); $N_i$ represents a volume of area i in the building (with a unit of cubic meter ($m^3$)); $T_i$ represents a dry-bulb temperature of the area i in the building (with a unit of ° C.); K represents the number of the area i in the building.

Step 2, based on the building heat storage model, a function relational expression of describing an indoor dry bulb temperature of the building and a cooling and heating load of the building is obtained.

Based on the RC model, 70% of an actual measured dataset is used as a training dataset of the building heat storage model, and 30% of the actual measured dataset is used as a testing dataset. Parameters of the building heat storage model are identified by a Grey Wolf Optimization (GWO) Algorithm. Finally, the building heat storage model can be simplified as the function relational expression between the cooling and heating load and the indoor dry-bulb temperature expressed as follows:

$$Q_{j,t} = f_B(a, T_{out,t}, T_{in,t}, T_{in,t-1}, b, c, d), \text{ and}$$

$$T_{in,t} = f_T(a, T_{out,t}, Q_{j,t}, T_{in,t-1}, b, c, d).$$

In the formula, $Q_{j,t}$ represents a cooling and heating load of the building at a moment t (with a unit of kW); a represents the parameters of the building heat storage model after identification, including 5 equivalent thermal resistors (with a unit of K/kW) and 4 equivalent thermal capacitors (with a unit of kJ/K); $T_{out,t}$ represents an outdoor dry bulb temperature of the building at the moment t (with a unit of ° C.); $T_{in,t}$ represents an indoor dry bulb temperature of the building at the moment t (with a unit of ° C.); $T_{in,t-1}$ represents an indoor dry bulb temperature of the building at a moment t−1 (with a unit of ° C.); b represents time parameters, including true solar time and date serial number; c represents internal disturbance parameters, including the number of the personnel, equipment power, lighting power, and per capita fresh air volume; $f_B$ ( . . . ) represents a calculation function of the building heat storage model for the cooling and heating load; and $f_T$ ( . . . ) represents a calculation function of the building heat storage model for the indoor temperature.

During identifying the parameters, based on actual factors such as thermal physical properties of materials of the envelope structure of the building, a water capacity and a terminal equipment form of the air conditioning system, and an indoor air capacity of the building in the embodiment, reasonable value ranges of the equivalent heat capacitors and the equivalent thermal resistors in the building heat storage model are restricted. The value ranges of the equivalent thermal resistors $R_1$, $R_2$, $R_3$, $R_m$, and $R_w$ are respectively at a range of 0.02 K/kW to 0.8 K/kW, 0.1 K/kW to 0.8 K/kW, 0.00001 K/kW to 0.17 K/kW, 0.01 K/kW to 0.27 K/kW, and 0.01 K/kW to 0.5 K/kW. The value ranges of the equivalent thermal resistors $C_2$, $C_3$ and $C_4$ are respectively at a range of 10 KJ/K to 100 KJ/K, 0.8 KJ/K to 150 KJ/K and 0.2 KJ/K to 1000 KJ/K.

For optimization parameters of the grey wolf Algorithm, the number of the group is set to 120, and a maximum number of iteration is 500. After iterative calculation, the identification results of the GWO Algorithm for the building heat storage model are obtained. For the equivalent heat capacitors of $R_1$, $R_2$, $R_3$, $R_m$, and $R_w$ are respectively 0.0326 K/kW, 0.153 K/kW, 0.0003 K/kW, 0.0189 K/kW, and 0.0457 K/kW; and the equivalent thermal resistors of $C_2$, $C_3$ and $C_4$ are respectively 22.75 KJ/K, 47.2 KJ/K, 1.1 KJ/K and 0.99 KJ/K.

Figure 3:
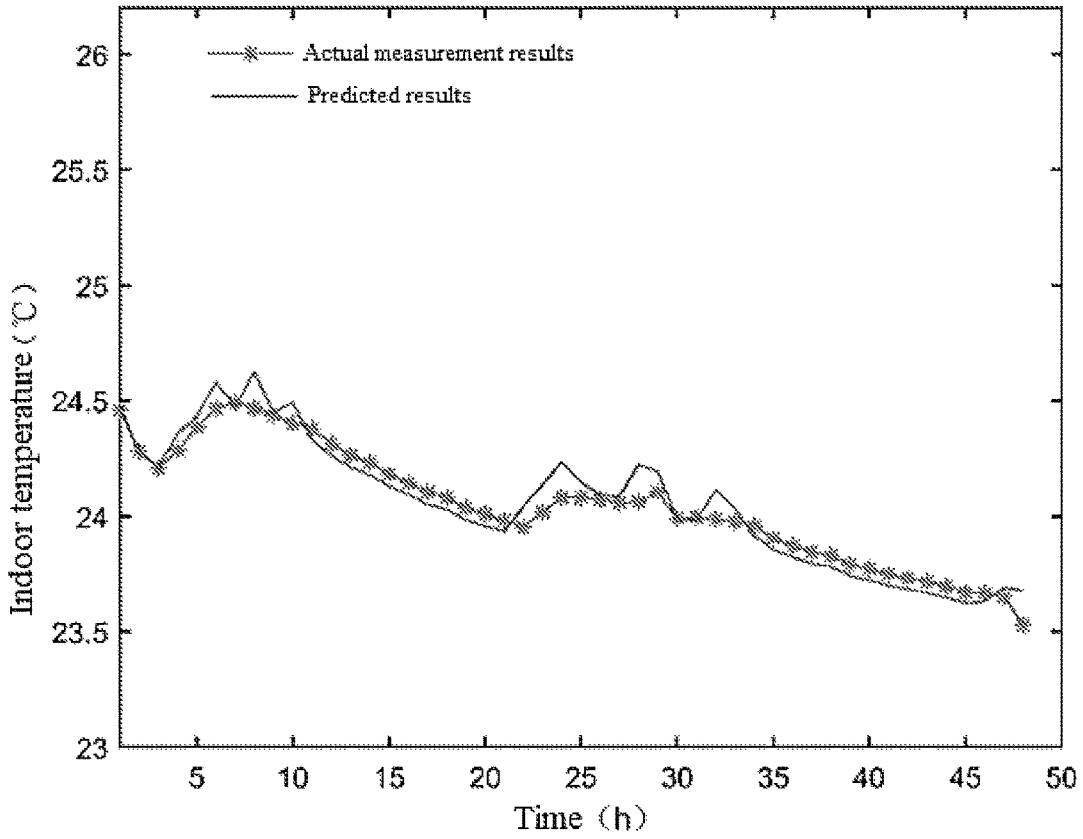
FIG. 3 illustrates a schematic comparative diagram of calculation results of indoor temperature based on a building heat storage model according to an embodiment of the disclosure.

In order to verify the accuracy of the calculation of the building heat storage model, the testing dataset is introduced into the building heat storage model, and the difference between the actual measured results and the calculated results of the building heat storage model is compared. Since the subsequent flexibility calculation of the air conditioning system requires that the building heat storage model can accurately calculate the indoor temperature and the cooling capacity of the building at the same time, so that, firstly, under the same cooling capacity conditions, the actual measured indoor temperature and the indoor temperature calculation results based on the building heat storage model are compared to verify the accuracy of the building heat storage model in the indoor temperature calculation, and the comparison of the calculation results in 48 hours is illustrated in FIG. 3. The comparison results show that the indoor temperature calculated by the building heat storage model is basically consistent with the actual measured results. In an accuracy evaluation index of the obtained model, a correlation coefficient $R^2$ of the model reached 90.8%, indicating that the calculation results of the model have a good following ability to the testing results. It can be considered that the calculation of the indoor temperature using the building heat storage model is accurate.

Figure 4:
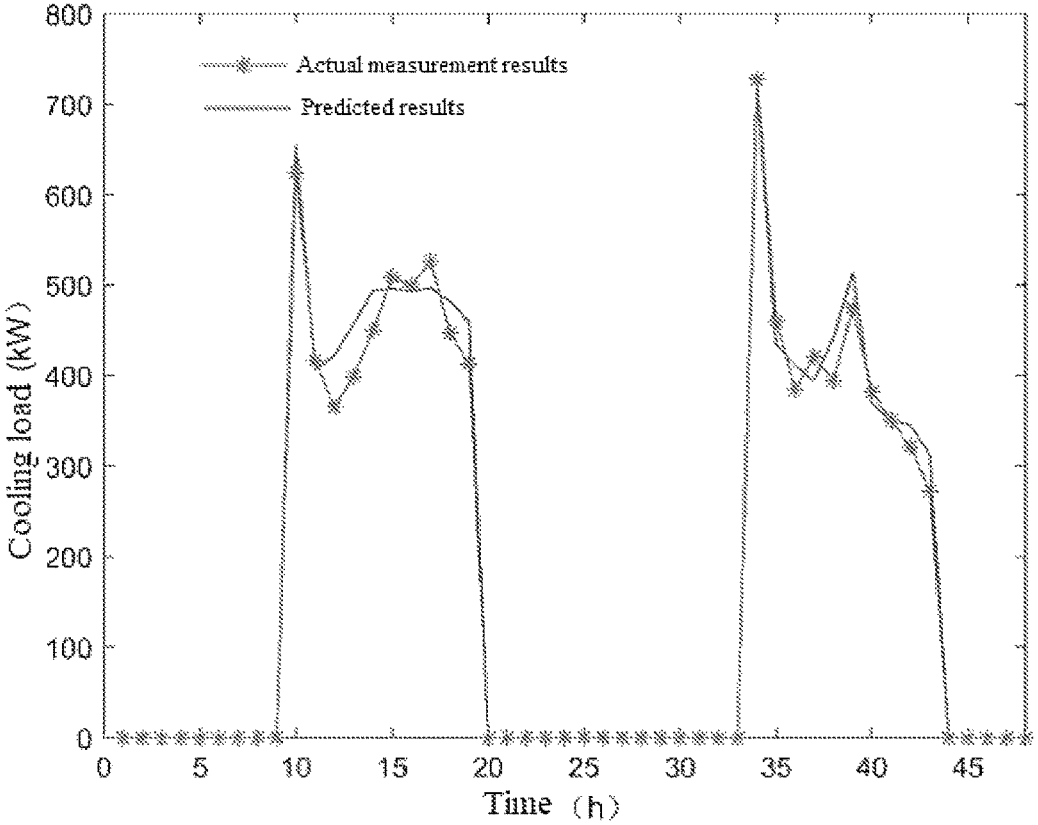
FIG. 4 illustrates a schematic comparative diagram of calculation results of cooling loads based on the building heat storage model according to the embodiment of the disclosure.

In addition, in order to verify the accuracy of the cooling load calculation of the building heat storage model, under the same change conditions of the indoor temperature, the actual measured cooling load of the building is compared with the cooling load calculated by the building heat storage model, and the calculation results of 48 h are illustrated in FIG. 4. Compared with a calculation error for the indoor temperature, a calculation error for the cooling load of the building heat storage model is relatively large, but it can basically reflect the change trend of the cooling load of the building. In an evaluation index of the building heat storage model, CV-RMSE (referred to a root mean square error of Circulation Volume) reaches 3.5%; while in a load forecast, CV-RMSE is less than 30%, which is regarded as an accurate prediction, so that it can be considered that the calculation of cooling load of the building heat storage model is accurate.

Step 3, based on the function relational expression obtained in the step 2, a power consumption calculation model under a working condition of demand response is constructed.

Based on the function relational expression obtained in the step 2, a cooling and heating source component model, an active energy storage component model, a passive energy storage component model, and an accessory component model are constructed. Parameter identification and model integration are respectively performed on the cooling and heating source component model, the active energy storage component model, the passive energy storage component model, and the accessory component model in sequence to obtain the power consumption calculation model of the air conditioning system under different working conditions of demand response.

A performance model of an air conditioning unit needs to be regressed. In the embodiment, the regression operation adopts a temperature correlation model, and uses a linear relationship between a reciprocal of a cooling loading capacity of the air conditioning unit (1/Q) and a reciprocal of a performance coefficient (1/cop) of the air conditioning unit to construct a relationship between the performance coefficient of the air conditioning unit and an evaporator inlet temperature of the air conditioning unit, the cooling loading capacity of the air conditioning unit and a condenser inlet temperature of the air conditioning unit. And the linear relationship is expressed as follows:

$$cop = \frac{1}{\left(a_1 \times \frac{T_e}{Q} + a_2 \times \frac{T_c - T_e}{Q} + 1\right) \times \frac{T_c}{T_c - a_3 \times Q} - 1}$$

In the formula, $a_1$, $a_2$ and $a_3$ represent parameters of the performance model of the air conditioning unit; $T_e$ represents the evaporator inlet temperature of the air conditioning unit (with a temperature of ° C.); $T_e$ represents the condenser inlet temperature of the air conditioning unit (with a temperature of ° C.); Q represents the cooling loading capacity of the air conditioning unit (with a unit of kW).

According to actual measured cooling loading capacity and power consumption of a heat pump unit, a performance curve of the heat pump unit is fitted by a least square method to obtain the power consumption calculation model. And the power consumption calculation model is expressed as follows:

$$cop = \frac{1}{\left(1.678 \times \frac{T_e}{Q} - 4.3356 \times \frac{T_c - T_e}{Q} + 1\right) \times \frac{T_c}{T_c - 0.00182 \times Q} - 1}$$

Through verifying an accuracy of the power consumption calculation model, $R^2$ (referred to a correlation coefficient) reaches 92.3%, indicating that the fitted power consumption calculation model can accurately reflect the performance variations of the air conditioning unit.

The cooling and heating source component model is constructed as follows.

The air conditioning unit consumes electric power by taking heat from a low temperature heating source and releasing heat to a high temperature heating source. The cooling and heating load capacity and the power consumption of the air conditioning unit can be calculated by the following formula:

$$Q_{jz,t} = 4.2 \times G_{jz,t} \times (T_{h,t} - T_{g,t}) \div 3.6, \text{ and}$$

$$E_{jz,t} = \frac{Q_{jz,t}}{cop_t}.$$

In the formula, $Q_{jz,t}$ represents a cooling and heating load capacity borne by the air conditioning unit at a moment t (with a unit of kW); $G_{jz,t}$ represents a chilled water flow of the air conditioning unit at the moment t (with a unit of cubic meter per hour ($m^3$/h)); $T_{h,t}$ represents a return water temperature of the air conditioning unit at the moment t (with a unit of ° C.); $T_{g,t}$ represents a water effluent temperature of the air conditioning unit at the moment t (with a unit of ° C.); $E_{jz,t}$ represents energy consumption of the air conditioning unit at the moment t (kW); $cop_t$ represents a performance coefficient of the air conditioning unit at the moment t.

The active energy storage component model (also referred to a water tank capable of storing energy) is constructed as follows.

A typical representative of the active energy storage component model is that the air conditioning system uses the water tank for ice cooling storage or water cooling storage to realize heat transfer, and uses a cooling storage capacity of the cooling storage water tank to store cooling in a valley power phase and release the cooling in a peak power phase, thereby meeting or partially meeting the cooling and heating load requirements of the building in the peak power phase.

Energy release process of the water tank is achieved by the following formulas:

$$Q_{f,t} = \min\begin{cases} 4.2 \times G_{f,t} \times (T_{h,t} - T_{g,t}) \div 3.6 \\ Q_{sy,t} \end{cases}$$

$$T_{g,t} = T_{f,min} + \Delta T_x \times \frac{Q_{sy,t}}{Q_{x,z}}$$

$$Q_{sy,t} = (Q_{sy,t-1} - Q_{f,t-1}) \times \Delta t$$

In the formula, $Q_{f,t}$ and $Q_{f,t-1}$ represent energy release of the energy storage water tank at a moment t and a moment t−1 (with a unit of kW); $G_{f,t}$ represents a flow of an energy release pump at the moment t (with a unit of $m^3$/h); $T_{h,t}$ represents a water inlet temperature of the energy storage water tank at the moment t (with a unit of C); $T_{g,t}$ represents a water outlet temperature of the energy release of the energy storage water tank at the moment t (with a unit of C); $Q_{sy,t}$, and $Q_{sy,t-1}$ represent remaining cooling loads of the energy storage water tank at the moment t and the moment t−1 (with a unit of kJ); $T_{f,min}$ represents a minimum energy storage temperature of the energy storage water tank (with a unit of ° C.); $\Delta T_x$ represents a setting temperature difference of the energy storage water tank (with a unit of ° C.); $Q_{x,z}$ represents a setting energy storage capacity of the energy storage water tank (with a unit of kJ); and $\Delta t$ represents a time interval (with a unit of h) for the energy release.

Energy storage process of the water tank is achieved by the following formula:

$$Q_{x,t} = \min\begin{cases} 4.2 \times G_{x,t} \times (T_{h,t} - T_{g,t}) \div 3.6 \\ Q_{f,z} - Q_{sy,t} \\ Q_{jz,z} \end{cases}$$

In the formula, $Q_{x,t}$ represents an energy storage capacity of the energy storage water tank at a moment t (with a unit of kW); $G_{x,t}$ represents a flow of an energy storage pump at the moment t (with a unit of $m^3$/h); $T_{h,t}$ represents the water inlet temperature of the energy storage water tank at the moment t (with a unit of C); $T_{g,t}$ represents the water outlet temperature of the energy release of the energy storage water tank at the moment t (with a unit of C); $Q_{sy,t}$ represents the remaining cooling load of the energy storage water tank at the moment t (with a unit of kJ); $Q_{jz,z}$ represents a rated cooling (heating) load capacity of the air conditioning unit (with a unit of kW); $Q_{f,z}$ represents a maximum cooling storage capacity of the energy storage water tank (with a unit of kJ).

The passive energy storage component model is constructed as follows.

The above type of component model refers to using energy storage capacities of the envelope structure of the building, the indoor furniture and the indoor air to realize the heat transfer and using thermal inertia in the building to reduce the indoor temperature by precooling or preheating the building in advance in the valley power phase, thereby reducing the cooling and heating load requirements of the building in the peak power phase. The passive energy storage component model focuses on describing the cooling and heating load that it reduces or transfers when participating in the demand response, which can be calculated by building load simulation software (white box model) or the lumped heat capacity model (gray box model). And the calculation process is expressed as follows:

$$Q_{B,t} = f_B(a, T_{out,t}, T_{in,t}, T_s, b, c, d) - Q_{j,t} = f_B(a, T_{out,t}, T_{s,t}, T_{s,t-1}, b, c, d)$$

In the formula, $Q_{B,t}$ represents a cooling and heating load that can be reduced by the passive energy storage component at a moment t (with a unit of kW); $f_B(\ldots)$ represents the calculation function of the building heat storage model for the cooling and heating load; $T_s$ represents a setting indoor temperature at the demand response phase (with a unit of ° C.); $T_{s,t}$ represents an indoor temperature under a working condition of a moment t (with a unit of ° C.); and $T_{s,t-1}$ represents an indoor temperature under a working condition of a moment t−1 (with a unit of ° C.).

The accessory component model is constructed as follows.

The accessory components in the air conditioning system refer to the components facilitating the normal operation of the air conditioning system, such as water pumps that provide circulating power, a cooling tower that dissipates heat to the environment, etc. Most of the accessory components operate at fixed frequency and are interlocked with critical equipment in the system to start and stop.

Water pump power consumption: the accessory component model calculates the water pump power consumption of the air conditioning system according to an electricity consumption to cooling (heating) ratio (EC(H)R) expressed as follows:

$$ECR = \frac{A \times (B + \propto \times \sum L)}{\Delta t}$$

$$E_{p,t} = ECR \times Q_{p,t}$$

In the formula, ECR represents the electricity consumption to cooling ratio of the water pump of the air conditioning system; A represents a calculation coefficient related to a flow of the water pump, which is selected according to an international standard (GB 50736-2012); B represents a calculation coefficient related to a machine room and user water resistance; $\propto$ represents a calculation coefficient related to ΣL; ΣL represents a total transmission length of a supply and return water pipeline from the machine room to a farthest user of the air conditioning system (with a unit of m); ΔT represents a temperature difference between supply and return water of the air conditioning system (with a unit of ° C.); $E_{p,t}$ represents a power consumption of the water pump of the air conditioning system (with a unit of kW); and $Q_{p,t}$ represents cooling and heating load delivered by the water pump (with a unit of kW).

Cooling tower power consumption: cooling towers are assumed to operate at a fixed frequency in the accessory component model, and the cooling tower power consumption is calculated by a formula as follows:

$$E_{ct,t}=ns_t \times E_{ct,s}.$$

In the formula, $E_{ct,t}$ represents a total power of cooling towers at a moment t (with a unit of kW); $ns_t$ represents the number of the cooling towers running at the moment t (with a unit of set); $E_{ct,s}$ represents a rated power of the cooling towers (with a unit of kW).

Step 4, optimization objective functions are constructed based on the power consumption calculation model.

The power consumption calculation model of the air conditioning system obtained from the step 3 is used to calculate the power consumption of the air conditioning system under a basic working condition without participating in the demand response, and to respectively construct calculation formulas of the optimization objective functions in the optimization process, including flexibility objective functions (referred to an energy flexibility objective function $f_f$, a power flexibility objective function $f_w$), a cost objective function $f_c$, and an energy consumption objective function $f_e$.

The flexibility objective functions are constructed as follows.

(1) A pre-cooling temperature, a pre-cooling time and a rated cooling load of the air conditioning system are brought into the indoor temperature calculation function ($f_T$) of the building heat storage model, and an indoor temperature of the building in non-working hours is calculated under a condition that the cooling and heating load of the building is equal to 0. Under a condition that the air conditioning system operates at full load, an indoor temperature of the building during the pre-cooling (pre-heating) phase is calculated. The indoor temperature of the building during the pre-cooling (pre-heating) phase is combined with a setting indoor temperature during working hours to obtain an indoor temperature change curve of the building based on the demand response.

A calculation formula at the non-working hours is expressed as follows: $T_{in}, =f_T(a, T_{out,t}, 0, T_{in,t-1}, b, c, d)$, and in the formula, the cooling and heating load of the building is equal to 0.

A calculation formula at the pre-cooling phase is expressed as follows: $T_{in,t}=f_T(a, T_{out,t}, Q_{jz,t}, T_{in,t-1}, b, c, d)$, and in the formula, the cooling and heating load of the building is equal to $Q_{jz,t}$.

A calculation formula at the working hours is expressed as follows:

$T_{in,t}=T_s$, and in the formula, $T_{in,t-1}$ represents an indoor temperature at a moment t−1, and the indoor temperature of the building needs to be calculated iteratively (with a unit of ° C.).

(2) The cooling and heating load of the building is calculated by using the passive energy storage component model and the indoor temperature curve constructed in the step 3 based on the demand response, which is expressed as follows:

$$Q_{B,t}=f_B(a, T_{out,t}, T_{in,t}, T_s, b, c, d).$$

(3) The energy storage strategy is introduced into the constructed cooling and heating source component model, the accessory component model, and the energy storage component models (including the active energy storage component model and the passive energy storage component model) to calculate the power consumption of the air-conditioning system under the premise that the cooling and heating load of the building meets the building demand response. Therefore, the difference between the calculated power consumption and the power consumption of the air-conditioning system under the basic working condition is an amount of electrical loads that the air-conditioning system can reduce or transfer. And the calculation formula is expressed as follows:

$$E_{d,t} = \frac{Q_{B,t} - Q_{f,t}}{cop_t} + E_{p,t} + E_{w,t},$$

$$f_{s,t} = E_{s,t} - E_{d,t}.$$

In the formula, $E_{d,t}$ represents the power consumption of the air conditioning system participating in the demand response at a moment t (with a unit of kW); $Q_{B,t}$ represents the cooling and heating load that can be reduced by the passive energy storage component model at the moment t (with a unit of kW); $Q_{f,t}$ represents the energy release of the energy storage water tank at the moment t (with a unit of kW); $cop_t$ represents the performance coefficient of the air conditioning system at the moment t; $E_{p,t}$ represents power consumption of the water pump in the air conditioning system at the moment t (with a unit of kW); $E_{s,t}$ represents the power consumption of the air conditioning system under the basic working condition at the moment t (with a unit of kW); $E_{w,t}$ represents the power consumption of the cooling tower (with a unit of kW).

(4) On the basis of the above power flexibility calculation, the energy flexibility objective function $f_f$ of the air conditioning system is an integral of the power reduction amount over time in the calculation period, and the power flexibility objective function $f_w$ is an average value of the electric power reduction amount in the calculation period. The calculation formulas are as follows:

$$f_f = \sum_{t=1}^{T} f_{s,t},$$

and in the formula, $f_f$ represents the energy flexibility objective function of the air conditioning system (with a unit of kilowatt hour (kWh); and $f_{s,t}$ represents an electrical power transferred or reduced by the air conditioning system at a moment t (with a unit of kW); and $f_w = \overline{f_{s,t}}$, and in the formula, $f_w$ represents the power flexibility objective function of the air conditioning system (with a unit of kW).

The cost objective function $f_c$ is constructed as follows:

$$f_c = \min(C_{storage} + C_{run}),$$

$$C_{storage} = \sum_{t=1}^{L}\sum_{i=1}^{z}\sum_{k=1}^{e}(c_{k,t} \times E_{i,k,t}), \text{ and}$$

$$C_{run} = \sum_{t=1}^{H}\sum_{i=1}^{z}\sum_{k=1}^{e}(c_{k,t} \times E_{i,k,t}).$$

In the formula, L represents a demand response time of the air conditioning system (with a unit of h); H represents a time for the energy storage of the air conditioning system (with a unit of h); $f_c$ represents the objective function of the cost (with a unit of rmb 'yuan'); $C_{run}$ represents a running cost of the air conditioning system (with a unit of rmb 'yuan'); $C_{storage}$ represents a cost of the energy storage of the air conditioning system (with a unit of rmb 'yuan'); $c_{k,t}$ represent a unit price (yuan/kWh) of consumed category k energy at a time t; $E_{i,k,t}$ represents energy consumption of a Class i equipment of the air conditioning system in the category k energy at the time t (kWh); z represents the number of the equipment; e represents the number of categories of energy; K represents the category k energy; i represents the Class i equipment.

The objective function of the energy consumption $f_e$ is constructed as follows:

$$f_e = \min\left(\sum_{t=1}^{T}\sum_{k=1}^{e} E_{t,k}\right).$$

In the formula, $f_e$ represents the objective function of the energy consumption (with a unit of kWh); $E_{t,k}$, represents an amount of the category k energy consumed by the air conditioning system at the time t hour (with a unit of kWh).

Step 5, the optimization objective functions are substituted into a bi-level optimization process and the bi-level optimization process is optimized to obtain an optimal scheduling strategy for the air conditioning system participating in demand response. Furthermore, in some embodiments, the bi-level optimization scheduling method further includes: scheduling the air conditioning system for the building under a demand response condition based on the optimal scheduling strategy.

The constructed objective functions are brought into a bi-level optimization structure. An upper-level optimization of the bi-level optimization structure is an optimization of day-ahead water tank energy storage capacity of the air conditioning system, and a minimum cost $f_e$, a minimum energy consumption $f_e$ and a maximum energy flexibility $f_f$ are used as optimization objectives to optimize the water tank energy storage capacity V in the energy storage phase under a condition of satisfying the equipment capacity constraint. A lower-level optimization is an optimization of daily running parameters of the air conditioning system, and the lower-level optimization takes objectives of the system running cost $C_{run}$, the energy consumption $f_e$ and the power flexibility $f_w$ into account to optimize the start/stop and power output of each equipment in the system while satisfying the capacity constraint, energy balance constraint and comfort constraint of each equipment.

A genetic algorithm and multi-objection decision-making method are used to solve and optimize the constructed bi-level optimization structure. During the optimization process, the day-ahead optimization results (energy storage V) become the constraint condition of the optimization process of the daily running parameters, while the running cost of the air conditioning system $C_{run}$, the energy consumption $f_e$ and the power flexibility $f_w$ generated after the optimization of the daily running parameters feeds back the calculation of the day-ahead optimization objective, and readjusts the water tank energy storage V of in the day-ahead optimization process. The optimization parameters between the upper and lower levels are transferred to each other, and finally the optimal allocation between the day-ahead water tank energy storage capacity of the air conditioning system and the daily running of the air conditioning system is achieved to obtain the optimal scheduling strategy of the air conditioning system based on the demand response.

The bi-level optimization scheduling method provided by the disclosure is compared with the optimization results of conventional single-level optimization scheduling methods to reflect its advantages. Namely, the optimization calculation is performed on the scheduling strategies for the air conditioning system based on the demand response under three methods of the conventional day-ahead water tank energy storage (referred to Case-day-ahead shown in FIGS. 5-6), daily running parameters (referred to Case-daily shown in FIGS. 5-6) and the bi-level optimization (referred to Case-bi-level shown in FIGS. 5-6) respectively to obtain the optimization results. The optimization results are as follows.

For the single-level optimization strategy of the day-ahead water tank energy storage capacity, the optimized water tank energy storage capacity is 897 kWh under a premise of setting the pre-cooling time of 5 h, the pre-cooling temperature of 22° C. and the average absolute temperature deviation of 1.2° C. For the single-level optimization strategy of the daily running parameters, the pre-cooling time is 4 h, the pre-cooling temperature is 23° C., and the average absolute temperature deviation of temperature reset is 1.3° C. under a premise of setting the day-ahead water tank energy storage capacity of 1200 kWh. However, for the bi-level optimization scheduling strategy proposed by the disclosure, the optimized water tank energy storage capacity is 1037 kWh, the precooling time is 4 h, the precooling temperature is 23° C., and the average absolute temperature deviation of temperature reset is 1.3° C.

Figure 5:
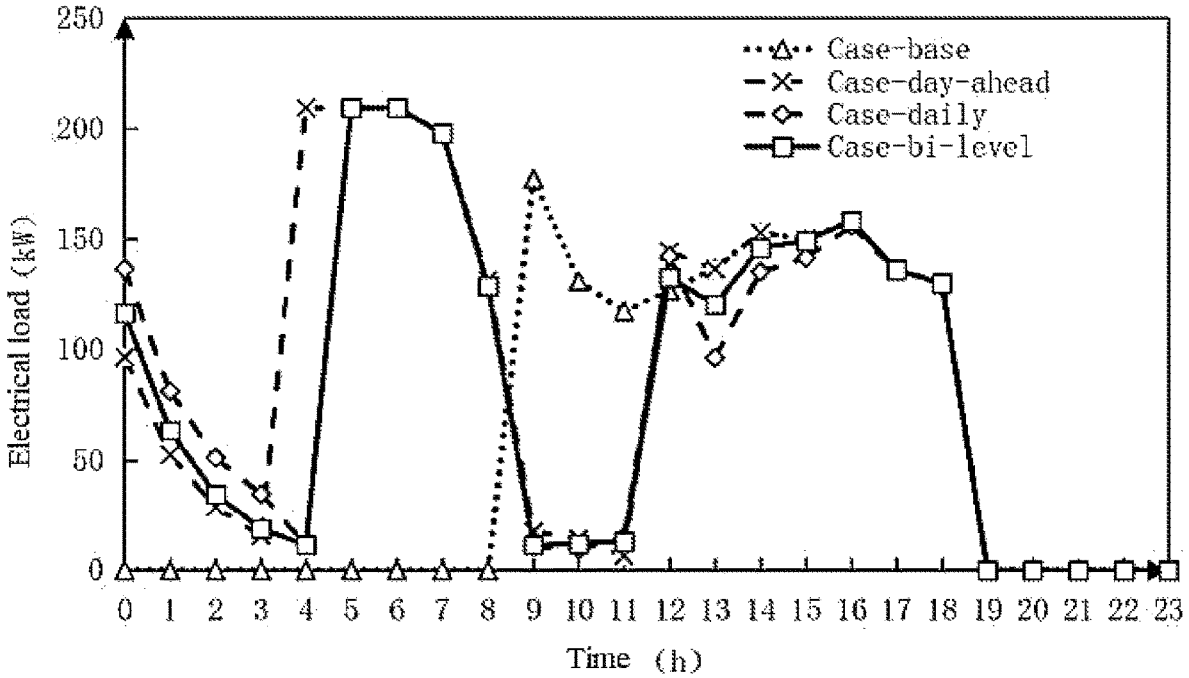
FIG. 5 illustrates a schematic comparative diagram of hour-by-hour electrical loads of the air conditioning system as per three optimization results according to an embodiment of the disclosure.

Therefore, based on the optimization results of the above three scheduling strategies for the air conditioning system, in order to analyze the differences in the working conditions of the system before and after the change of the water tank energy storage capacity, the hour-by-hour electric loading of the system needs to be further compared among the three scheduling strategies, as shown in FIG. 5. It can be seen from FIG. 5 that under the strategy of Case-day-ahead, the air conditioning system runs under the maximum power flexibility. At this time, 8 units in the air condition unit start up 5 hours in advance (at 3:00 am) and continue to run, precooling the building to the setting temperature of 22° C., and combining the active energy storage and indoor temperature reset to transfer the electric loading of 91% of the peak electricity price period (at 8:00 am to 11:00 am). At this time, the units in the air conditioning system are closed, and the requirement of the cooling load of the building can be satisfied only by the energy release of the water tank, achieving a relatively good demand response effect. However, it is worth noting that when the Case-bi-level strategy considers the optimal daily running for the air-conditioning system during setting the day-ahead water tank energy storage capacity, the optimization scheduling strategy makes the air conditioning unit only need to start up 4 hours in advance and pre-cool the building to 23° C., achieving 91.4% of the peak electric loading transfer, which illustrated the better electric loading transfer ability than that of the Case-day-ahead strategy. The above mainly due to that the bi-level optimization scheduling strategy uses the active energy storage strategy with higher energy storage efficiency to partially replace the passive energy storage strategy with extremely low energy storage efficiency by reasonably improving the water tank energy storage capacity, thereby making the air-conditioning system show better economy and energy saving under the premise of having the same electric loading transfer capacity.

However, comparing the running state of the air-conditioning system under the Case-daily strategy and the Case-bi-level strategy in FIG. 5, the performance between the two optimization scheduling strategies in the system running phase is not significantly different. At 4:00 am to 12:00 pm and 16:00 pm to 23:00 pm, the electric loadings of the air conditioning system under the two scheduling strategies are basically the same, while the difference in setting the day-ahead water tank energy storage capacity makes the electric loading of the air conditioning system in the energy storage phase increase 30.1%, and the electric loading reduction in the energy release phase increase 7.8% in the Case-daily strategy; however, it is worth noting that the transferred electric loading is located in the flat price period from 12:00 pm to 17:00 pm, reflecting the economic benefit of the loading transfer is very low, thereby increasing the running cost of the air conditioning system by 1.4%. It shows that the bi-level optimization scheduling method can make full use of the demand response potential of the energy storage equipment, effectively use the day-ahead water tank energy storage capacity and improve the economy and energy saving while running the system.

In summary, it is found that compared with the single-level optimization scheduling methods, the bi-level optimization scheduling method can achieve the reasonable allocation between the day-ahead water tank energy storage capacity and the daily running parameters of the system, and fully tap the demand response potential of the energy storage equipment. Furthermore, the bi-level optimization scheduling method ensures the optimization scheduling of the demand response strategies by setting the reasonable water tank energy storage capacity, improves the economy and energy saving while running the system, and has no significant impact on the electric loading transfer of the system.

Figure 6:
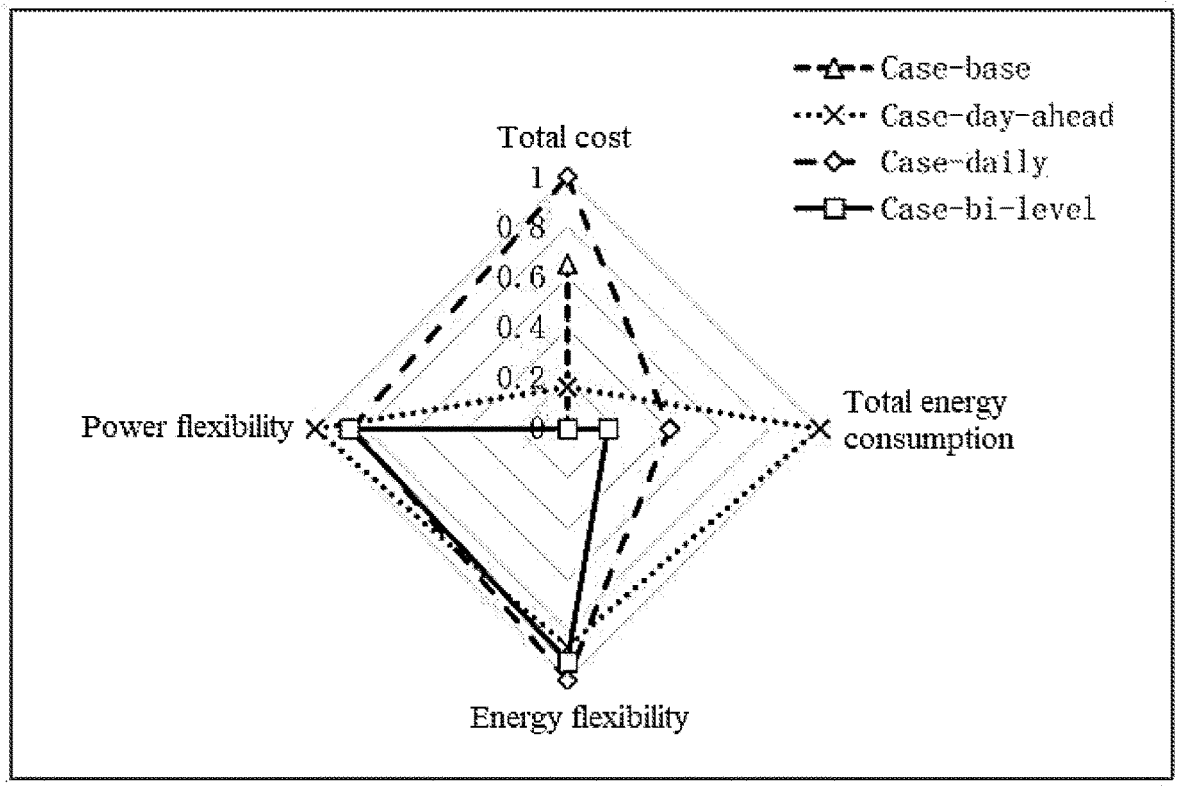
FIG. 6 illustrates a percentage radar diagram of demand response effects of the air conditioning system as per the three optimization results according to an embodiment of the disclosure.

Finally, in order to more intuitively illustrate the beneficial effects of the bi-level optimization scheduling method, four properties of the air conditioning system including the total cost, the total energy consumption, the energy flexibility and the power flexibility, are compared under the above three optimization scheduling strategies. Furthermore, the radar diagram of the four properties based on the demand response is illustrated according to the calculation results, as shown in FIG. 6. A variety of indexes are normalized during illustrating the radar diagram, so that it can be simply understood in FIG. 6 that the closer to the number 1, the larger the index is, and the closer to 0, the smaller the index is. It can be seen from FIG. 6 that the bi-level optimization scheduling method illustrates obvious economy and energy efficiency advantages because it realizes the reasonable allocation between the day-ahead water tank energy storage capacity and the daily running parameters. The total cost and the total energy consumption of the air conditioning system are 1.7% and 15.9% lower than that of the conventional Case-day-ahead scheduling method, and 9.6% and 13.8% lower than that of the conventional Case-daily scheduling method. In terms of the flexibilities, the bi-level optimization scheduling method has no significant impact on the energy flexibility and power flexibility of the system. Compared with the maximum values under the three optimization scheduling methods, the power flexibility and the energy flexibility reduce no more than 10%. Therefore, in the aspect of the optimization scheduling for the air conditioning system, the bi-level optimization scheduling method can achieve better demand response effect than the single-level optimization scheduling method, indicating significant advantages.

The above display and description only describe basic principles, main features and advantages of the disclosure. Those skilled in the art should understand that the disclosure is not limited by the above described embodiments. The above described embodiments and the specification only describe the principle of the disclosure. Without departing from the spirit and scope of the disclosure, there will be various changes and improvements in the disclosure. These changes and improvements fall within the protection scope of the disclosure. The protection scope of the disclosure falls within the described embodiments of the disclosure and their equivalent replacements.

What is claimed is:

1. A bi-level optimization scheduling method for an air conditioning system based on demand response, comprising following steps:

step 1, constructing a lumped heat capacity model to describe a heat storage capacity of a building, thereby obtaining a building heat storage model;

step 2, based on the building heat storage model, obtaining a function relational expression of describing an indoor dry bulb temperature of the building and a cooling and heating load of the building;

step 3, based on the function relational expression, constructing a power consumption calculation model under a working condition of demand response;

step 4, based on the power consumption calculation model, constructing optimization objective functions; and step 5, substituting the optimization objective functions into a bi-level optimization process, and optimizing the bi-level optimization process to obtain an optimal scheduling strategy for the air conditioning system participating in demand response;

wherein the lumped heat capacity model in the step 1 describes the heat storage capacity of the building in four aspects; and the four aspects comprise: a heat storage capacity of walls of an envelope structure of the building, a heat storage capacity of indoor air of the building, a heat storage capacity of partition walls, furniture and roof thermal mass of the building, and a heat storage capacity of an air conditioning water system;

wherein the lumped heat capacity model comprises: a 3R1C heat storage model of the envelope structure of the building, a 1R1C heat storage model of indoor thermal mass of the building, and a 1R1C heat storage model of the air conditioning water system of the building;

wherein a heat transfer process of the walls of the envelope structure of the building is expressed as follows:

$$Q_s + \frac{T_{out} - T_w}{R_1} + \frac{T_{in} - T_w}{R_2} = C_1 \frac{dT_w}{dt}$$

$$Q_w = \frac{T_{out} - T_{in}}{R_w} + Q_l$$

$$Q_{l,n} = \alpha \times A_{l,n} \times I_{s,n}$$

$$Q_l = Q_{l,n} + Q_{l,w} + Q_{l,s} + Q_{l,e}$$

wherein in the formula, $R_1$ and $R_2$ represent equivalent thermal resistors for heat transfer of opaque exterior envelope structure of the building; $T_w$ represents a temperature of a virtual node of the opaque exterior envelope structure of the building; $Q_s$ represents solar radiation heat absorbed by surfaces of the envelope structure; $C_1$ represents an equivalent thermal capacitor of the opaque exterior envelope structure of the building; $Q_w$ represents heat entering indoor through transparent envelope structure; $Q_{l,n}$ represents solar radiation heat transmitted by north transparent envelope structure of the building; Qu represents solar radiation heat transmitted by the transparent envelope structure of the building; $R_w$ represents an equivalent thermal resistor for heat transfer of the transparent envelope structure of the building; $T_{out}$ represents a dry bulb temperature of an outdoor environment of the building; $T_{in}$ represents a volume average dry bulb temperature of indoor space of the building; $\alpha$ represents a transmittance of the transparent envelope structure of the building; $A_{l,n}$ represents an area of the north transparent envelope structure of the building; $I_{s,n}$ represents solar radiation intensity perpendicular to the north transparent envelope structure of the building; and $Q_{l,w}$, $Q_{l,s}$, $Q_{l,e}$ represent solar radiation heat transmitted by west transparent envelope structure, south transparent envelope structure and east transparent envelope structure of the building, and calculation methods of the $Q_{l,w}$, the $Q_{l,s}$, and the $Q_{l,e}$ are consistent with a calculation method of the north transparent envelope structure of the building;

wherein a heat transfer process of the inner thermal mass of the building is expressed as follows:

$$Q_l + \frac{T_{in} - T_m}{R_m} = C_3 \frac{dT_m}{dt}$$

wherein in the formula, $Q_l$ represents the solar radiation heat transmitted by the transparent envelope structure of the building; $T_m$ represents a temperature of a node of the inner thermal mass of the building; $T_{in}$ represents the volume average dry bulb temperature of the indoor space of the building; $R_m$ represents an equivalent thermal resistor for heat transfer of the indoor thermal mass of the building; $C_3$ represents an equivalent thermal capacitor of the inner thermal mass of the building;

wherein a heat transfer process of the air conditioning water system of the building is expressed as follows:

$$Q_h + \frac{T_{in} - T_h}{R_3} = C_4 \frac{dT_h}{dt}$$

wherein in the formula, $Q_h$ represents a heat supply capacity of the air conditioning system in the building; $T_{in}$ represents the volume average dry bulb temperature of the indoor space of the building; $T_h$ represents a temperature of a virtual node of the air conditioning water system; $R_3$ represents an equivalent thermal resistor for heat transfer of a terminal equipment in the air conditioning system; and $C_4$ represents an equivalent thermal capacitor of the air conditioning water system;

wherein a heat transfer process of the indoor air of the building is expressed as follows:

$$\frac{T_w - T_{in}}{R_2} + \frac{T_h - T_{in}}{R_3} + \frac{T_m - T_{in}}{R_m} + \frac{T_{out} - T_{in}}{R_w} + Q_g + Q_{fr} + Q_u + Q_b = C_2 \frac{dT_{in}}{dt}$$

$$T_{in} = \frac{\sum_{i=1}^{k} N_i \times T_i}{k}$$

wherein in the formula, $T_w$ represents the temperature of the virtual node of the opaque exterior envelope structure of the building; $T_{in}$ represents the volume average dry bulb temperature of the indoor space of the building; $R_2$ represents the equivalent thermal resistor for heat transfer of the opaque exterior envelope structure; $T_h$ represents the temperature of the virtual node of the air conditioning water system; $R_3$ represents the equivalent thermal resistor for heat transfer of the terminal equipment in the air conditioning system; $T_m$ represents the temperature of the node of the inner thermal mass of the building; $T_{out}$ represents the dry bulb temperature of the outdoor environment of the building; $R_w$ represents the equivalent thermal resistor for heat transfer of the transparent envelope structure of the building; $Q_g$ represents heat dissipation of personnel inside the building; $Q_{fr}$ represents heat dissipation of indoor fresh air of the building; $Q_u$ represents heat dissipation of indoor equipment of the building; $Q_b$ represents heat dissipation of indoor lighting of the building; $N_i$ represents a volume of area i in the building; $T_i$ represents a dry-bulb temperature of the area i in the building; and k represents a number of the area i in the building;

wherein the step 2 comprises: identifying parameters in the building heat storage model based on Grey Wolf algorithm to obtain the function relational expression between the indoor dry bulb temperature of the building and the cooling and heating load of the building;

wherein based on a RC model, 70% of an actual measured dataset is used as a training dataset of the building heat storage model, and 30% of the actual measured dataset is used as a testing dataset; parameters of the building heat storage model are identified by the Grey Wolf algorithm; and the building heat storage model is simplified as the function relational expression between the indoor dry bulb temperature of the building and the cooling and heating load of the building as follows:

$$Q_{j,t}=f_B(a,T_{out,t},T_{in,t},T_{in,t-1},b,c,d)$$

$$T_{in,t}=f_T(a,T_{out,t},Q_{j,t},T_{in,t-1},b,c,d)$$

wherein in the formula, $Q_{j,t}$ represents a cooling and heating load of the building at a moment t; a represents the parameters of the building heat storage model after identification, including 5 equivalent thermal resistors and 4 equivalent thermal capacitors; $T_{out,t}$ represents an outdoor dry bulb temperature of the building at the moment t; $T_{in,t}$ represents an indoor dry bulb temperature of the building at the moment t; $T_{in,t-1}$ represents an indoor dry bulb temperature of the building at a moment t−1; b represents time parameters, comprising: true solar time and date serial number; c represents internal disturbance parameters, comprising: a number of the personnel, equipment power, lighting power, and per capita fresh air volume; $f_B$ ( . . . ) represents a calculation function of the building heat storage model for the cooling and heating load; and $f_T$ ( . . . ) represents a calculation function of the building heat storage model for the indoor temperature;

wherein the step 3 comprises: based on the function relational expression, constructing a cooling and heating source component model, an active energy storage component model, a passive energy storage component model, and an accessory component model; and performing parameter identification and model integration on the cooling and heating source component model, the active energy storage component model, the passive energy storage component model, and the accessory component model in sequence to obtain the power consumption calculation model;

wherein a performance model of an air conditioning unit is configured to be regressed, comprising: adopting a temperature correlation model and using a linear relationship between a reciprocal of a cooling loading capacity of the air conditioning unit and a reciprocal of a performance coefficient of the air conditioning unit to construct a relationship between the performance coefficient of the air conditioning unit and an evaporator inlet temperature of the air conditioning unit, the cooling loading capacity of the air conditioning unit and a condenser inlet temperature of the air conditioning unit that is expressed as follows:

$$cop=\frac{1}{\left(a_1\times\frac{T_e}{Q}+a_2\times\frac{T_c-T_e}{Q}+1\right)\times\frac{T_c}{T_c-a_3\times Q}-1}$$

wherein in the formula, $a_1$, $a_2$, and $a_3$ represent parameters of the performance model of the air conditioning unit; $T_e$ represents the evaporator inlet temperature of the air conditioning unit; $T_c$ represents the condenser inlet temperature of the air conditioning unit; and Q represents the cooling loading capacity of the air conditioning unit;

wherein according to actual measured cooling loading capacity and power consumption of a heat pump unit, a performance curve of the heat pump unit is fitted by a least square method to obtain the power consumption calculation model that is expressed as follows:

$$cop=\frac{1}{\left(1.678\times\frac{T_e}{Q}-4.3356\times\frac{T_c-T_e}{Q}+1\right)\times\frac{T_c}{T_c-0.00182\times Q}-1}$$

wherein through verifying an accuracy of the power consumption calculation model, $R^2$ reaches 92.3%, indicating that the fitted power consumption calculation model is configured to accurately reflect performance variations of the air conditioning unit;

wherein in the cooling and heating source component model, the air conditioning unit consumes electric power by taking heat from a low temperature heating source and releasing heat to a high temperature heating source; and a cooling and heating load capacity and a power consumption of the air conditioning unit is calculated by the following formula:

$$Q_{jz,t}=4.2\times G_{jz,t}\times(T_{h,t}-T_{g,t})\div 3.6$$

$$E_{jz,t}=\frac{Q_{jz,t}}{cop_t}$$

wherein in the formula, $Q_{jz,t}$ represents the cooling and heating load capacity borne by the air conditioning unit at a moment t; $G_{jz,t}$ represents a chilled water flow of the air conditioning unit at the moment t; $T_{h,t}$ represents a return water temperature of the air conditioning unit at the moment t; $T_{g,t}$ represents a water effluent temperature of the air conditioning unit at the moment t; $E_{jz,t}$ represents the power consumption of the air conditioning unit at the moment t; and $cop_t$ represents a performance coefficient of the air conditioning unit at the moment t;

wherein in the active energy storage component model, the air conditioning unit uses a water tank for ice cooling storage or a water cooling storage to realize heat transfer, and uses a cooling storage capacity of the cooling storage water tank to store cooling in a valley power phase and release the cooling in a peak power phase, thereby meeting or partially meeting cooling and heating load requirements of the building in the peak power phase;

wherein an energy release process of the water tank is achieved by the following formulas:

$$Q_{f,t}=\min\begin{cases}4.2\times G_{f,t}\times(T_{h,t}-T_{g,t})\div 3.6\\ Q_{sy,t}\end{cases}$$

$$T_{g,t}=T_{f,min}+\Delta T_x\times\frac{Q_{sy,t}}{Q_{x,z}}$$

$$Q_{sy,t}=(Q_{sy,t-1}-Q_{f,t-1})\times\Delta t$$

wherein in the formula, $Q_{f,t}$ and $Q_{f,t-1}$ represent energy release of the energy storage water tank at a moment t and a moment t−1; $G_{f,t}$ represents a flow of an energy release pump at the moment t; $T_{h,t}$ represents a water inlet temperature of the energy storage water tank at the moment t; $T_{g,t}$ represents a water outlet temperature of the energy release of the energy storage water tank at the moment t; $Q_{sy,t}$, and $Q_{sy,t-1}$ represent remaining cooling loads of the energy storage water tank at the moment t and the moment t−1; $T_{f,min}$ represents a minimum energy storage temperature of the energy storage water tank; $\Delta T_x$ represents a setting temperature difference of the energy storage water tank; $Q_{x,z}$ represents a setting energy storage capacity of the energy storage water tank; and Δt represents a time interval for the energy release;

wherein an energy storage process of the water tank is achieved by the following formula:

$$Q_{x,t} = \min\begin{cases} 4.2 \times G_{x,t} \times (T_{h,t} - T_{g,t}) \div 3.6 \\ Q_{f,z} - Q_{sy,t} \\ Q_{jz,z} \end{cases}$$

wherein in the formula, $Q_{x,t}$ represents an energy storage capacity of the energy storage water tank at a moment t; $G_{x,t}$ represents a flow of an energy storage pump at the moment t; $T_{h,t}$ represents the water inlet temperature of the energy storage water tank at the moment t; $T_{g,t}$ represents the water outlet temperature of the energy release of the energy storage water tank at the moment t; $Q_{sy,t}$ represents the remaining cooling loads of the energy storage water tank at the moment t; $Q_{jz,z}$ represents a rated cooling load capacity or a rated heating load capacity of the air conditioning unit; and $Q_{f,z}$ represents a maximum cooling storage capacity of the energy storage water tank;

wherein the passive energy storage component model is configured to use energy storage capacities of the envelope structure of the building, the indoor furniture and the indoor air to realize the heat transfer and use thermal inertia in the building to reduce the indoor temperature by precooling or preheating the building in advance in the valley power phase, thereby reducing the cooling and heating load requirements of the building in the peak power phase;

wherein the passive energy storage component model focuses on describing the cooling and heating load that the passive energy storage component model reduces or transfers when participating in the demand response, which is calculated by building load simulation software or the lumped heat capacity model as follows:

$$Q_{B,t}=f_B(a,T_{out,t},T_{in,t},T_s,b,c,d)-f_B(a,T_{out,t},T_{s,t},T_{s,t-1},b,c,d)$$

wherein in the formula, $Q_{B,t}$ represents a cooling and heating load that is reduced by the passive energy storage component at a moment t; $f_B$ ( . . . ) represents the calculation function of the building heat storage model for the cooling and heating load; $T_s$ represents a setting indoor temperature participating in the demand response; $T_{s,t}$ represents an indoor temperature under a working condition of a moment t; and $T_{s,t-1}$ represents an indoor temperature under a working condition of a moment t−1;

wherein the accessory components in the air conditioning system comprise: components facilitating a normal operation of the air conditioning system, most of the accessory components operate at a fixed frequency and are interlocked with critical equipment in the air conditioning system to start and stop;

wherein in a water pump power consumption, the accessory component model calculates the water pump power consumption of the air conditioning system according to an electricity consumption to cooling ratio by the following formulas:

$$ECR = \frac{A \times (B + \propto \times \sum L)}{\Delta t}$$

$$E_{p,t} = ECR \times Q_{p,t}$$

wherein in the formulas, ECR represents the electricity consumption to cooling ratio of the water pump of the air conditioning system; A represents a calculation coefficient related to a flow of the water pump; B represents a calculation coefficient related to a machine room and user water resistance; ∝ represents a calculation coefficient related to $\Sigma_L$; $\Sigma_L$ represents a total transmission length of a supply and return water pipeline from the machine room to a farthest user of the air conditioning system; Δt represents a temperature difference between supply and return water of the air conditioning system; $E_{p,t}$ represents a power consumption of the water pump of the air conditioning system; and $Q_{p,t}$ represents cooling and heating load delivered by the water pump;

wherein in a cooling tower power consumption, cooling towers are assumed to operate at a fixed frequency in the accessory component model, and the cooling tower power consumption is calculated by a formula as follows:

$$E_{ct,t}=ns_t \times E_{ct,s}$$

wherein in the formula, $E_{ct,t}$ represents a total power of the cooling towers at a moment t; $ns_t$ represents a number of the cooling towers running at the moment t; $E_{ct,s}$ represents a rated power of the cooling towers;

wherein the optimization objective functions in the step 4 comprise: flexibility objective functions, a cost objective function, and an energy consumption objective function;

wherein the power consumption calculation model of the air conditioning system obtained from the step 3 is used to calculate the power consumption of the air conditioning system under a basic working condition without participating in the demand response, and to respectively construct calculation formulas of the optimization objective functions in the optimization process, comprising: the flexibility objective functions, a cost objective function $f_c$, and an energy consumption objective function $f_e$; and the flexibility objective functions comprise: an energy flexibility objective function $f_f$ and a power flexibility objective function $f_w$;

wherein the flexibility objective functions are constructed as follows: brining a pre-cooling temperature, a pre-cooling time and a rated cooling load of the air conditioning system into an indoor temperature calculation function of the building heat storage model, calculating an indoor temperature of the building in non-working hours under a condition that the cooling and heating load of the building is equal to 0; under a condition that the air conditioning system operates at full load, calculating an indoor temperature of the building during the pre-cooling or the pre-heating phase; and combining the indoor temperature of the building during the pre-cooling or the pre-heating phase with a setting indoor temperature during working hours to obtain an indoor temperature change curve of the building based on the demand response;

wherein a calculation formula at the non-working hours is expressed as follows:

$$T_{in,t}=f_T(a,T_{out,t},0,T_{in,t-1},b,c,d)$$

wherein in the formula, the cooling and heating load of the building is equal to 0;

wherein a calculation formula at the pre-cooling phase is expressed as follows:

$$T_{in,t}=f_T(a,T_{out,t},Q_{jz,t},T_{in,t-1},b,c,d)$$

wherein in the formula, the cooling and heating load of the building is equal to $Q_{jz,t}$;

wherein a calculation formula at the working hours is expressed as follows:

$$T_{in,t}=T_s$$

wherein in the formula, $T_{in,t-1}$ represents an indoor temperature at a moment t-1, and the indoor temperature of the building is calculated iteratively;

wherein the cooling and heating load of the building is calculated by using the passive energy storage component model and the indoor temperature curve constructed in the step 3 based on the demand response, which is expressed as follows:

$$Q_{B,t}=f_B(a,T_{out,t},T_{in,t},T_s,b,c,d)$$

wherein an energy storage strategy is introduced into the cooling and heating source component model, the accessory component model, and the energy storage component models to calculate the power consumption of the air-conditioning system under a premise that the cooling and heating load of the building meets the building demand response; and a difference between the calculated power consumption and the power consumption of the air-conditioning system under the basic working condition is an amount of electrical loads that the air-conditioning system can reduce or transfer, which is expressed as follows:

$$E_{d,t} = \frac{Q_{B,t} - Q_{f,t}}{cop_t} + E_{p,t} + E_{w,t}$$

$$f_{s,t} = E_{s,t} - E_{d,t}$$

wherein in the formula, Eat represents the power consumption of the air conditioning system participating in the demand response at a moment t; $Q_{B,t}$ represents the cooling and heating load that can be reduced by the passive energy storage component model at the moment t; $Q_{f,t}$ represents the energy release of the energy storage water tank at the moment t; $cop_t$ represents a performance coefficient of the air conditioning system at the moment t; $E_{p,t}$ represents power consumption of the water pump in the air conditioning system at the moment t; $E_{s,t}$ represents the power consumption of the air conditioning system under the basic working condition at the moment t; $E_{w,t}$ represents the power consumption of the cooling tower;

wherein based on the power flexibility calculation, the energy flexibility objective function $f_f$ of the air conditioning system is an integral of the power reduction amount over time in the calculation period, and the power flexibility objective function $f_w$ is an average value of the electric power reduction amount in the calculation period expressed as follows:

$$f_f = \sum_{t=1}^{T} f_{s,t}$$

wherein in the formula, $f_f$ represents the energy flexibility objective function of the air conditioning system; and $f_{s,t}$ represents an electrical power transferred or reduced by the air conditioning system at a moment t; and $$f_w=\overline{f_{s,t}}$$

wherein in the formula, $f_w$ represents the power flexibility objective function of the air conditioning system;

wherein the cost objective function $f_c$ is constructed by the following formulas:

$$f_c = \min(C_{storage} + C_{run})$$

$$C_{storage} = \sum_{t=1}^{L}\sum_{i=1}^{z}\sum_{k=1}^{e}(c_{k,t} \times E_{i,k,t})$$

$$C_{run} = \sum_{t=1}^{H}\sum_{i=1}^{z}\sum_{k=1}^{e}(c_{k,t} \times E_{i,k,t})$$

wherein in the formulas, L represents a demand response time of the air conditioning system; H represents a time for the energy storage of the air conditioning system; $f_c$ represents the objective function of the cost; $C_{run}$ represents a running cost of the air conditioning system; $C_{storage}$ represents a cost of the energy storage of the air conditioning system; $c_{k,t}$ represent a unit price of consumed category k energy at a time t; $E_{i,k,t}$ represents energy consumption of a class i equipment of the air conditioning system in the category k energy at the time t; z represents a number of the equipment; e represents a number of energy categories; k represents the category k energy; and i represents the class i equipment;

wherein the objective function of the energy consumption $f_e$ is constructed as follows:

$$f_e = \min\left(\sum_{t=1}^{T}\sum_{k=1}^{e} E_{t,k}\right)$$

wherein in the formula, $f_e$ represents the objective function of the energy consumption; $E_{t,k}$, represents an amount of the category k energy consumed by the air conditioning system at the time t hour;

wherein the bi-level optimization process comprises:

an upper-level optimization, which is an optimization of day-ahead water tank energy storage capacity of the air conditioning system, and a lower-level optimization, which is an optimization of daily running parameters of the air conditioning system;

wherein the constructed objective functions are brought into a bi-level optimization structure; the upper-level optimization of the bi-level optimization structure is an optimization of day-ahead water tank energy storage capacity of the air conditioning system, and a minimum cost $f_c$, a minimum energy consumption $f_e$ and a maximum energy flexibility $f_f$ are used as optimization objectives to optimize the water tank energy storage capacity V in the energy storage phase under a condition of satisfying the equipment capacity constraint; the lower-level optimization is an optimization of daily running parameters of the air conditioning system, and the lower-level optimization takes objectives of the system running cost $C_{run}$, the energy consumption $f_e$ and the power flexibility $f_w$ into account to optimize the start/stop and power output of each equipment in the system while satisfying the capacity constraint, energy balance constraint and comfort constraint of each equipment; and wherein a genetic algorithm and multi-objection decision-making method are used to solve and optimize the constructed bi-level optimization structure; during the optimization process, the day-ahead optimization results become a constraint condition of the optimization process of the daily running parameters, while the running cost of the air conditioning system $C_{run}$, the energy consumption $f_e$ and the power flexibility $f_w$ generated after the optimization of the daily running parameters feeds back the calculation of the day-ahead optimization objective, and readjusts the water tank energy storage V of in the day-ahead optimization process; the optimization parameters between the upper and lower levels are transferred to each other, and finally the optimal allocation between the day-ahead water tank energy storage capacity of the air conditioning system and the daily running of the air conditioning system is achieved to obtain the optimal scheduling strategy of the air conditioning system based on the demand response;

wherein the bi-level optimization scheduling method further comprises: adjusting the water tank energy storage capacity, a precooling time, a precooling temperature, and an average absolute temperature deviation of temperature reset of the air conditioning system based on the optimal scheduling strategy to operate the air conditioning system based on the adjusted water tank energy storage capacity, the adjusted precooling time, the adjusted precooling temperature, and the adjusted average absolute temperature deviation of temperature reset, thereby improving economy and energy saving of the air conditioning system in operation under the premise of meeting a load reduction demand.

2. The bi-level optimization scheduling method as claimed in claim 1, wherein the air conditioning system comprises: a water tank and air conditioning units, and the operating the air conditioning system, comprises:

performing energy storage on the water tank in a valley power phase to make the water tank reach the water tank energy storage capacity, and releasing, by the water tank, energy for cooling the building in a peak power phase; and operating the air conditioning units for the precooling time to precool the building to the precooling temperature.

3. The bi-level optimization scheduling method as claimed in claim 2, wherein the air conditioning system further comprises: water pumps and cooling towers, and the operating the air conditioning system, further comprises:

controlling the water pumps and the cooling towers to start and stop.

* * * * *